United States Patent [19]

Mulder

[11] 4,058,382

[45] Nov. 15, 1977

[54] HOT-GAS RECIPROCATING MACHINE WITH SELF-CENTERED FREE PISTON

[75] Inventor: Jan Mulder, Eindhoven, Netherlands

[73] Assignee: U.S. Philips Corporation, New York, N.Y.

[21] Appl. No.: 744,521

[22] Filed: Nov. 24, 1976

[30] Foreign Application Priority Data

Dec. 5, 1975 Netherlands ..... 7514182

[51] Int. Cl.[2] ..... F25B 9/00
[52] U.S. Cl. ..... 62/6
[58] Field of Search ..... 62/6

[56] References Cited

U.S. PATENT DOCUMENTS

| | | | |
|---|---|---|---|
| 2,897,655 | 8/1959 | Jonkers et al. | 62/6 |
| 3,650,118 | 3/1972 | O'Neil | 62/6 |
| 3,788,772 | 1/1974 | Noble et al. | 62/6 |
| 3,937,018 | 2/1976 | Beale | 62/6 |
| 3,991,585 | 11/1976 | Mulder | 62/6 |

*Primary Examiner*—Lloyd L. King
*Attorney, Agent, or Firm*—Frank R. Trifari; David R. Treacy

[57] ABSTRACT

A hot-gas reciprocating machine having a free piston, one face of which varies the volume of a working space while its other face bounds a buffer space of constant pressure. A control mechanism maintains a constant nominal central piston position by momentarily connecting the working space and the buffer space.

5 Claims, 5 Drawing Figures

HOT-GAS RECIPROCATING MACHINE WITH SELF-CENTERED FREE PISTON

The invention relates to a hot-gas reciprocating machine, comprising at least one working space in which a working medium completes a thermodynamic cycle, the working space comprising a compression space and an expansion space of mutually different mean temperature during operation, the said spaces being interconnected via heat exchangers, including a regenerator; and at least one free piston which is reciprocatable in a cylinder, one face of the piston varying the volume of the working space, its other face forming part of the boundary of a buffer space in which working medium is also present under a pressure which is at least substantially constant during operation and which corresponds to the mean working medium pressure in the working space.

Hot-gas reciprocating machines are to be understood to mean herein cold-gas refrigerating machines, hot-gas engines and heat pumps.

A hot-gas reciprocating machine of the kind set forth is known from Netherlands Patent Application 7405725, to which U.S. Pat. No. 3,991,585 corresponds, in which the free piston of a cold-gas refrigerating machine supports an armature coil which is powered by an alternating current and which is subjected to Lorentz forces in a permanent magnetic field for the reciprocating movement of this free piston.

Use can be made of a spring to fix the central position of the piston. In the case of a large stroke of the piston, however, the spring must be very long, which implies instability of movement of the spring. This gives rise to lateral forces on the piston which cause fast wear of piston and/or cylinder, the efficiency of the machine then also being reduced. Moreover, the mounting of the spring poses problems. If the spring is not mounted exactly centrally and/or the center line of the spring is not a straight line, detrimental frictional forces also occur.

Controlling the central position of the piston is also a problem if no spring is used. During operation a leakage flow of working medium from the working space to the buffer space and vice versa always occurs via the gap between the piston and the cylinder wall. Working medium flows from the working space to the buffer space during the part of the sinusoidal pressure variation in the working space in which this pressure exceeds the constant pressure in the buffer space, and in the reverse direction when the former pressure is lower.

Both volume flows ($cm^3/s$) of working medium from and to the working space are equal.

However, Applicant has recognized the fact that because the pressure, and hence the density, of the working medium which leaves the working space is higher than the pressure and the density of the working medium which flows from the buffer space to the working space, the mass flow (g/s) of working medium from the working space to the buffer space is larger than that from the buffer space to the working space. As a result, the central position of the piston shifts in the direction of the working space.

Conversely, the central position of the piston may move in the direction of the buffer space, for example, due to the weight of the piston itself.

The invention has for its object to provide a hot-gas reciprocating machine of the kind set forth in which the drawback of a shifting central position of the free piston during operation is eliminated.

To accomplish this, in accordance with the invention, if the mean piston position deviates from the desired nominal central position, a control mechanism instantaneously brings the working space in communication with the buffer space at instants corresponding to such an instantaneous pressure of the working medium participating in the cycle that the nominal central position is restored by supplying or extracting working medium to or from the working space as a result of the instantaneous pressure difference between the two spaces.

In a preferred embodiment of the hot-gas reciprocating machine in accordace with the invention, the control mechanism is formed by one or more ducts in the piston itself. One end of the ducts opens into the working space while the other end opens into the piston wall cooperating with the cylinder wall, where they correspond, in a given position of the piston, with one or more ducts in the cylinder wall which communicate with the buffer space.

A further preferred embodiment of the hot-gas reciprocating machine in accordance with the invention is characterized in that the control mechanism is formed by two elements which are present in the buffer space and which are reciprocatable relative to each other, the first element being connected to the piston and the second element being rigidly arranged, the first element being provided with one or more ducts, one end of which opens into the working space whilst their other end corresponds, in a given position of the two elements relative to each other, to one or more ducts in the second element which communicate with the buffer space.

When the first element is connected to the piston so that it is adjustable in the movement direction of the piston relative to the piston, an advantage is obtained in that the nominal central position of the piston is adjustable. This advantage is also achieved by arranging the second element in the buffer space to be adjustable in the movement direction of the piston relative to the buffer space.

The invention will be described in detail hereinafter with reference to the drawing which diagrammatically shows, in addition to a graph illustrating the principle, some embodiments of the hot-gas reciprocating machine (not to scale).

FIG. 1 is a longitudinal sectional view of a cold-gas refrigerating machine in which the control mechanism for maintaining the nominal central position of the free piston is formed by the piston itself.

FIG. 2 graphically shows the pressure (P) as a function of the time ($t$) for the working medium ($P_1$) participating in the cycle in a working space of a hot-gas reciprocating machine and for the working medium ($P_2$) in the buffer space of the said machine.

Figure 1:
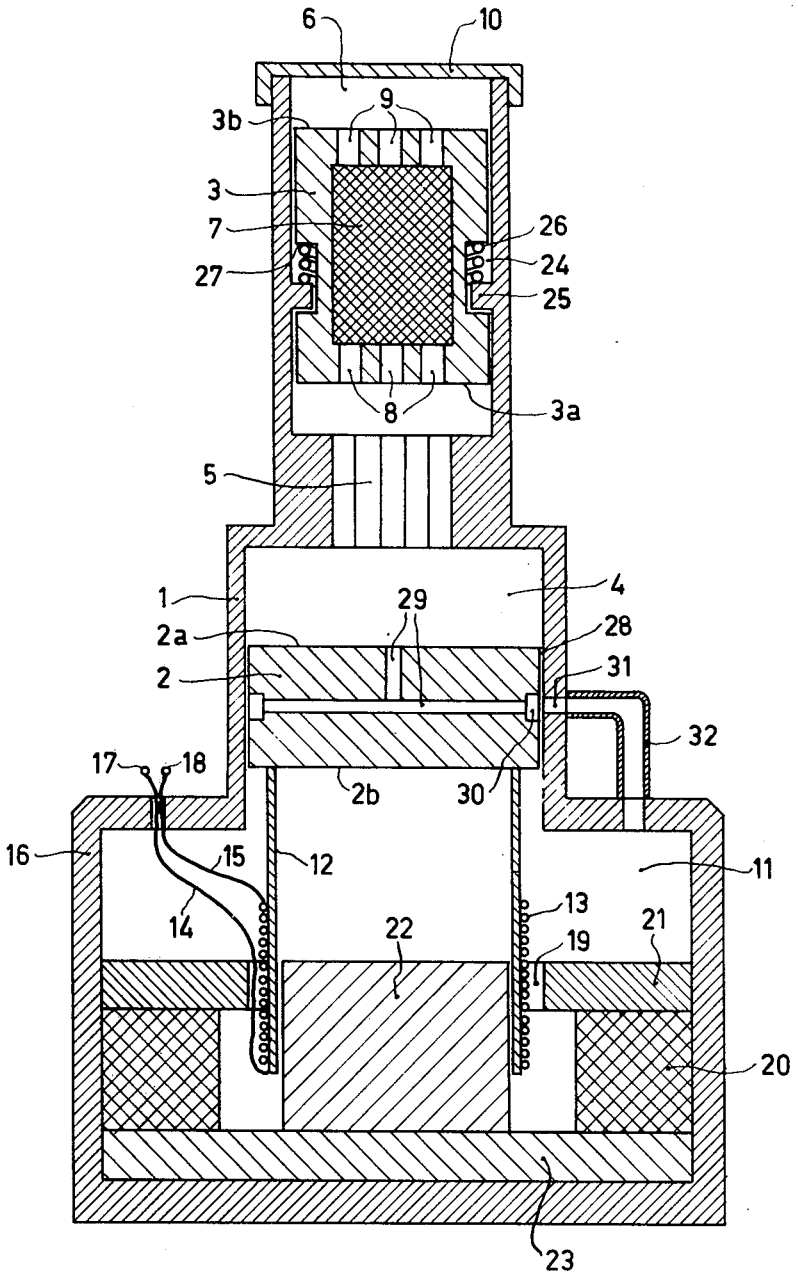

The reference 1 in FIG. 1 denotes a cylinder in which a free piston 2 and a free displacer 3 are reciprocatable at a mutual phase difference. Between the working surface 2*a* of the piston 2 and the working surface 3*a* of the displacer 3 there is a compression space 4 in which a cooler 5 is accommodated. The upper working surface 3*b* of the displacer 3 bounds an expansion space 6 which, in conjunction with the compression space 4, constitutes the working space. In the displacer 3 there is provided a regenerator 7 which is accessible to working medium on the lower side via bores 8 and on the upper side via bores 9. The machine comprises a freezer 10 as a heat exchanger for the exchange of heat between expanded cold, working medium and an object to be cooled.

When the piston 2 and the displacer 3 move at a phase difference with respect to each other during operation, a working medium (for example, helium or hydrogen) in the working space of the machine is alternately compressed and expanded, cold being produced as a result of the expansion. Compression of the working medium takes place when the working medium is present mainly in the compression space 4. The working medium successively flows via the cooler 5, while giving off compression heat, the bores 8, the regenerator 7, while giving off heat, and the bores 9 to the expansion space 6. Expansion of the working medium takes place when it is present mainly in the expansion space 6. The working medium then flows back in the reverse order along the said path after heat has been taken up in the freezer 10 from the object to be cooled (not shown), while the previously stored heat is taken up again in the regenerator 7.

The lower side 2*b* of the free piston 2 bounds a buffer space 11 in which working medium is also present at a pressure which is substantially constant during operation and which corresponds to the mean working medium pressure in the working space. The lower side 2*b* of the piston supports a lightweight sleeve 12 of nonmagnetic and nonmagnetizable material such as hard paper or aluminum. Around the sleeve 12 an electrical current conductor is wound to form an armature coil 13 which has connected to it power supply leads 14 and 15 which are fed through the wall of a housing 16, connected to the cylinder 1 in a gastight manner, and which have electrical contacts 17 and 18, respectively. The armature coil 13 is reciprocatable in the axial direction of the piston 2 in an annular slot 19 in which a permanent magnetic field prevails, the lines of force of which extend in radial directions, transversely of the movement direction of the armature coil.

The permanent magnetic field is obtained in the present case by means of an annular permanent magnet 20 comprising poles which are situated on the upper and the lower side, a soft iron ring disk 21, a solid soft iron cylinder 22 and a soft iron circular disk 23.

The permanent magnet and the soft iron components together constitute a closed magnetic circuit, that is to say a circuit of closed magnetic lines of force. During operation, the contacts 17 and 18 are connected to a source of electrical alternating current (for example, the mains) having the frequency $f_o$ (for example, 50 Hz). Under the influence of the permanent magnet field in the gap 19, the armature coil 13, carryign alternating current, is alternately subjected to upwards and downwards directed Lorentz forces, with the result that the assembly formed by the piston 2, the sleeve 12 and the armature coil 13 starts to resonate. This is effected so that the resonant frequency of the system formed by the moving assembly and the working medium in the working space at least substantially equals the alternating current frequency $f_o$ (a deviation of 10% is still acceptable). The working medium in the working space acts as a spring system. The alternating current should add, via the armature coil 13, only so much energy to the resonating system formed by the piston/armature coil assembly and working medium as is required for compensation for the labor performed by the working medium and for the friction losses. The displacer 3 locally has a smaller diameter, so that an annular intermediate space 24 is formed between the cylinder 1 and the displacer 3. The wall of the cylinder 1 is provided with a projection 25. A resilient element 26 is connected on the one side to the projection 25 and on the other side to the annular face 27 of the displacer 3.

The resilient element 26 limits the stroke of the displacer 3 and constitutes, in conjunction therewith, a mass/spring system so that the displacer performs, like the piston, a purely harmonic movement of the same frequency as the piston, but at a phase difference with respect thereto. The spring constant of the resilient element 26 and the mass of the displacer 3 are chosen so that the frequency $f_1$ at which this system can resonate is higher than the resonant frequency $f$ of the system formed by the piston/armature coil assembly and the working medium. During operation, at equal resonant frequency of piston 2 and displacer 3, the volume variation of the expansion space 6 leads the pressure variation occurring in this space, with the result that cold is produced in the expansion space 6. The refrigerating machine described thus far is known from U.S. Pat. No. 3,991,585.

Figure 2:
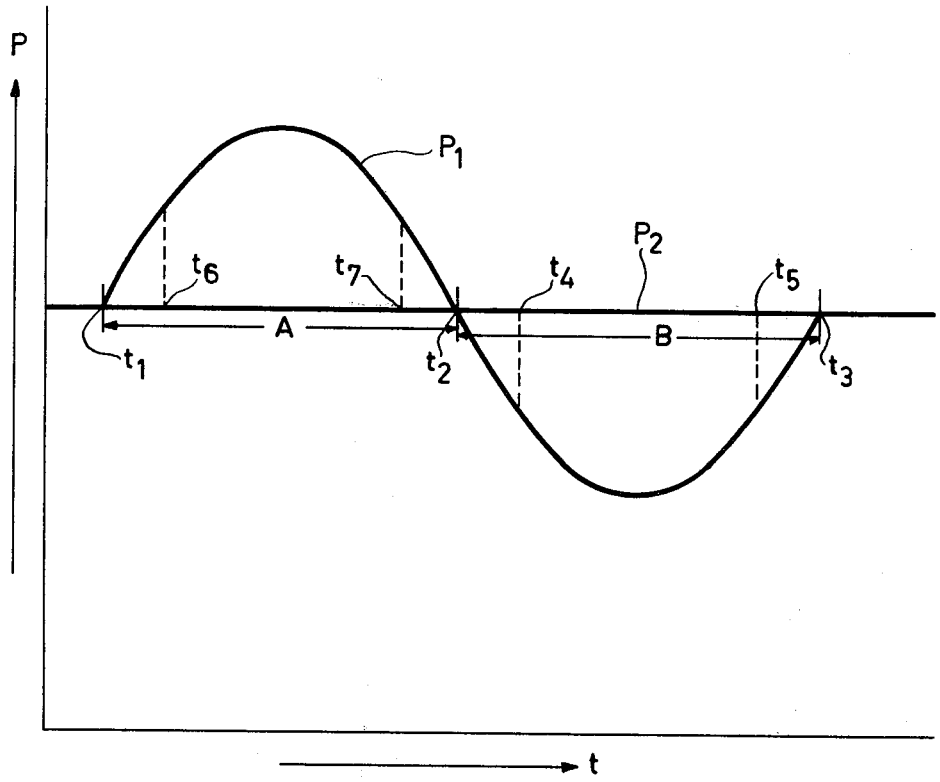

The improvement will now be described. As appears from FIG. 2, during the time interval A, the cycle pressure $P_1$ in the working space 4, 6 of FIG. 1 is higher than the pressure $P_2$ in the buffer space 11. Due to leakage via the gap 28 between the wall of the piston 2 and the cylinder 1, working medium then flows from the working space 4, 6 to the buffer space 11. During the time interval B (FIG. 2), however, the pressure in the buffer space 11 is higher than that in the working space 4, 6, so that medium then flows from the buffer space 11, through the gap 28, to the working space 4, 6. However, the pressure of the medium flowing out of the working space during the interval A is higher than the pressure of the medium flowing out of the buffer space during the interval B. This means that the medium volume flows to and from the working space are equal, but not the mass flows. The medium mass flow to the buffer space 11 exceeds that to the working space 4, 6. As a result, the piston 2 gradually assumes a higher central position, which means that the central position of the piston is shifted in the direction of the compression space 4. In order to prevent this phenomenon, the piston 2 is provided with a system of ducts 29 which communicates on the one end with the compression space 4 and which opens on the other end into an annular duct 30 which cooperates with a port 31 in the wall of the cylinder 1, the said port being in open communication with the buffer space 11 via a duct 32.

If the piston 2 reciprocates in the desired nominal central position, the annular duct 30 passes the port 31 at the instants $t_1$, $t_2$ and $t_3$ (FIG. 2) at which the pressures in the working space and the buffer space are equal.

Consequently, no medium flows through the duct system 29 and the duct 32.

If the mean piston position shifts upwards due to a medium mass flow from the compression space 4 through the gap 28 to the buffer space 11 which is larger than the mass flow in the reverse direction, the ring duct 30 passes, during the downward movement of the piston 2, the port 31 at an instant, for example, $t_4$, which is later than $t_2$, while during the upward movement of the piston 2 the annular duct 30 passes the port 31 at the instant $t_5$ which is earlier than the instant $t_3$. As a result, at the instants $t_4$ and $t_5$, at which the pressure $P_2$ in the buffer space 11 is larger than the pressure $P_1$ in the working space 4, 6, working medium flows from the buffer space 11, via the duct 32, the port 31, the annular duct 30 and the duct system 29, to the compression space 4. The piston 2 thus occupies the original, nominal central position again.

Should the mean postion of the piston 2 shift downwards, that is, in the direction of the soft iron cylinder 22, for example, under the influence of its own weight, the annular duct 30 passes, during the upward movement of the piston 2, the port 31 at an instant, for example, $t_6$ which is later than $t_2$ (FIG. 2), and during the downward movement of the piston 2 at an instant $t_7$ which is earlier than $t_2$. At the instants $t_6$ and $t_7$, at which the pressure $P_1$ in the working space 4, 6 exceeds the pressure $P_2$ in the buffer space 11, working medium then flows from the compression space 4, via the duct system 29, the annular duct 30, the port 31 and the duct 32, to the buffer space 11, with the result that the original central position of the piston is restored.

Figure 3:
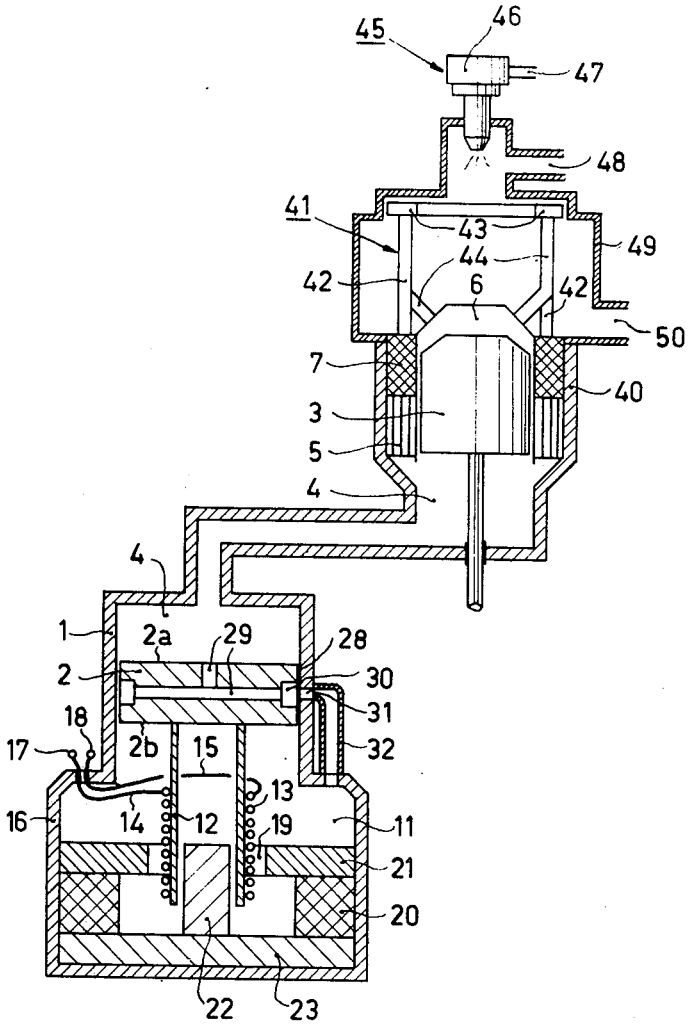
FIG. 3 is a longitudinal sectional view of a hot-gas reciprocating engine for generating electrical energy (generator), in which the control mechanism for maintaining the central position of the free piston is again formed by the piston itself.

Components of the hot-gas engine shown in FIG. 3 which correspond to components of the cold-gas refrigerating machine shown in FIG. 1 are denoted by the same reference numerals.

The compression space 4 communicates, via the cooler 5, the regenerator 7 which is rigidly arranged inside a cylinder 40, and a heater 41, with the expansion space 6. The heater 40 comprises a number of pipes 42 which are connected on the one end to the regenerator 7 and on the other end to an annular duct 43, and a number of pipes 44 which open on the one end into the annular duct 43 and on the other end into the expansion space 6.

Heat originating from a burner device 45 is given off to the working medium flowing through the heater pipes 42, 44 during operation. The burner device 45 comprises a burner 46 having a fuel inlet 47 and an air inlet 48. After having given off heat to the heater 41 arranged inside a housing 49, the combustion gases leave the housing 49 via the exhaust 50.

The displacer 3 is coupled, by way of a displacer rod 51, to a drive not shown. During operation of the hot-gas engine, during which the displacer 3 and the piston 2 move at a phase difference relative to each other, the heat energy applied to the heater 41 is utilized to drive the piston 2, so that electrical energy is generated in the armature coil 13. When the displacer 3 is provided with an electrodynamic drive, part of the electrical energy generated in the armature coil 13 can be utilized, after starting of the hot-gas engine, for the power supply of the armature coil coupled to the displacer rod 3.

The control of the central position of the piston 2 is identical to that of FIG. 1, so that no further description is given.

Figure 4:
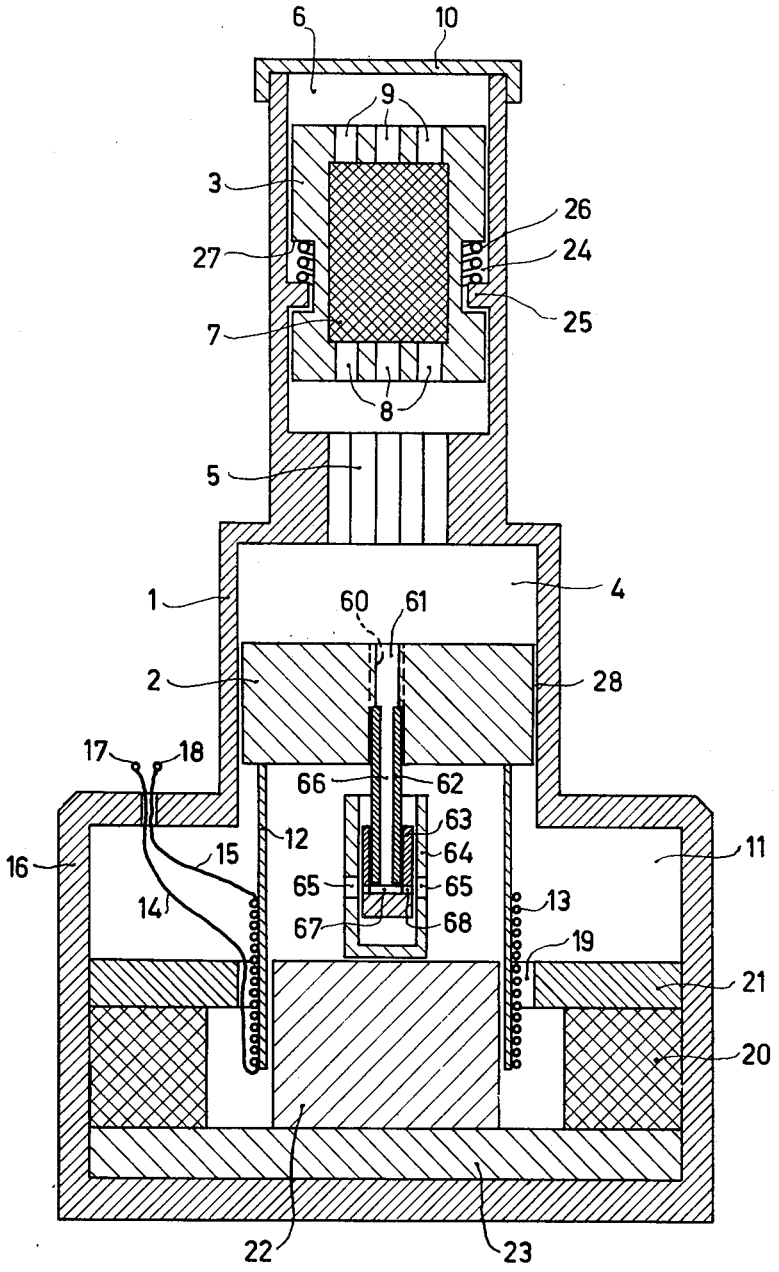
FIG. 4 is a longitudinal sectional view of a cold-gas refrigerating machine in which the control mechanism is formed by a slide which is reciprocatable in a housing and which is secured to the free piston to be axially adjustable with respect thereto.

The cold-gas refrigerating machine shown in FIG. 4 is substantially the same as that shown in FIG. 1. Corresponding components are again denoted by the same reference numerals. The difference consists in the construction of the control mechanism. In the present case a bore 61 with a thread 60 is provided in the piston 2; in the bore a tube 62 is screwed which supports a slide 63 which is reciprocatable in a housing 64 provided with ports 65. In the situation shown, the compression space 4 is in open communication with the buffer space 11 via the bore 61, the ducts 66 and 67, the annular duct 68 and the ports 65. The operation of the control mechanism is identical to that described with reference to FIG. 1.

The nominal central position of the piston 2 can be varied by screwing the tube 62 further in or out of the bore 61.

Figure 5:
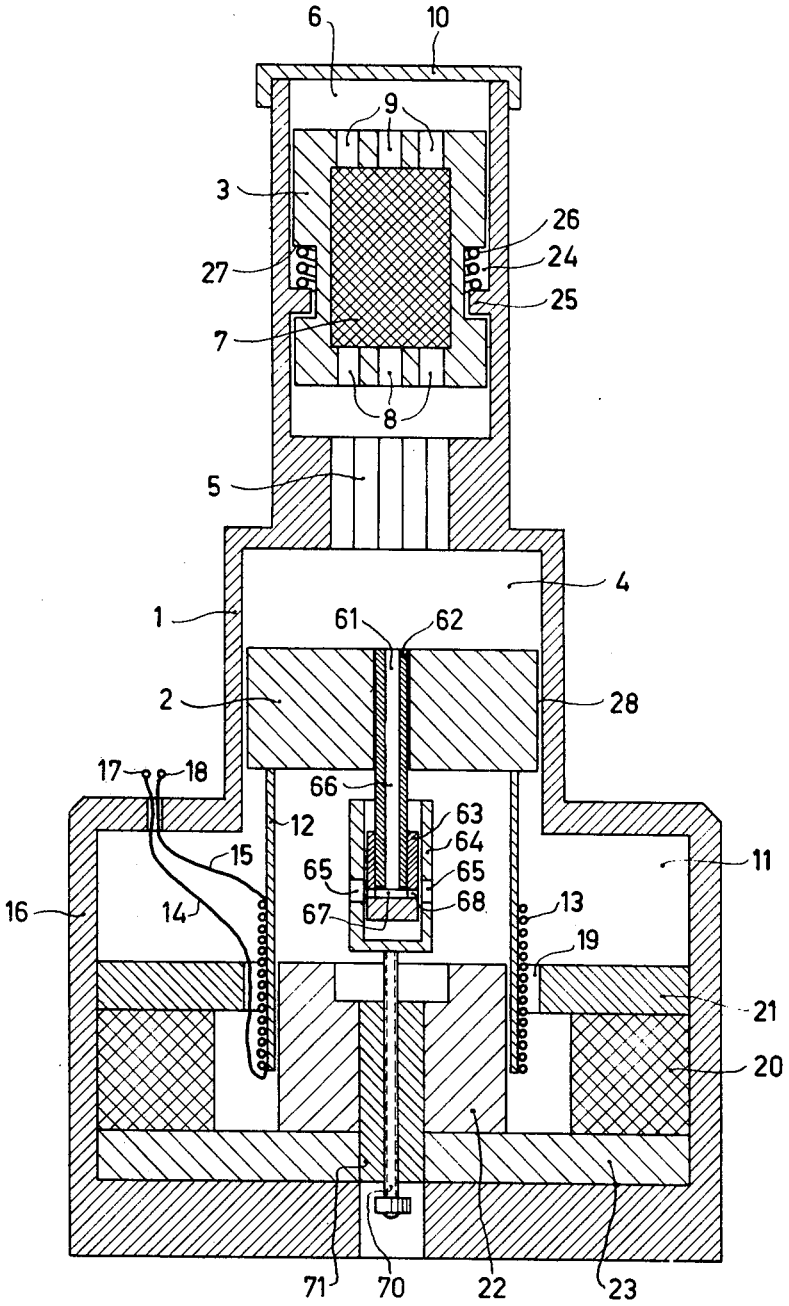
FIG. 5 is a longitudinal sectional view of a cold-gas refrigerating machine comprising a control mechanism in the form of a slide which is reciprocatable in a housing and which is secured to the free piston, the housing being axially adjustable with respect to the buffer space.

Components of the cold-gas refrigerating machine shown in FIG. 5 which correspond to those of FIG. 4 are denoted by the same reference numerals.

In this case the tube 62 is rigidly connected to the piston 2, while the housing 64 is adjustable in the axial direction by means of an adjusting screw 70 in a bush 71. Thus, the nominal central piston position is again adjustable, an additional advantage being obtained in that the adjustment can be externally effected during operation.

Although the slide is connected to the piston and the housing is rigidly arranged in the FIGS. 4 and 5, obviously the reverse is also possible.

Instead of coaxially cooperating elements of the control mechanism it is also possible, for example, to utilize two flat elements.

What is claimed is:

1. In a hot-gas reciprocating machine, comprising at least one working space in which a working medium completes a thermodynamic cycle, the working space comprising a compression space and an expansion space of mutually different mean temperature during operation, said spaces being interconnected via heat exchangers, including a regenerator; and at least one free piston which is reciprocatable in a cylinder, one face of the piston varying the volume of the working space, its other face forming part of the boundary of a buffer space in which working medium is also present under a pressure which is at least substantially constant during operation and which corresponds to the mean working medium pressure in the working space, the improvement comprising a control mechanism responsive to deviation of the mean piston position from a desired nominal central position, for instantaneously bringing the working space in communication with the buffer space at instants corresponding to such an instantaneous pressure of the working medium participating in the cycle that the nominal central position is restored by supplying or extracting working medium to or from the working space as a result of the instantaneous pressure difference between the two spaces.

2. A hot-gas reciprocating machine as claimed in claim 1, characterized in that the control mechanism is formed by one or more ducts in the piston, one end thereof opening into the working space while their other end opens into a wall of the piston cooperating with the cylinder wall, said duct other end being arranged to correspond, in a given position of the piston, with one or more ducts in the cylinder wall which communicate with the buffer space.

3. A hot-gas reciprocating machine as claimed in claim 1, characterized in that the control mechanism is formed by two elements in the buffer space which are reciprocatable relative to each other, the first element being connected to the piston and the second element being rigidly arranged, the first element being provided with one or more ducts, one end of which opens into the working space while their other end corresponds, in a given position of the two elements relative to each other, to one or more ducts in the second element which communicate with the buffer space.

4. A hot-gas reciprocating machine as claimed in claim 3, characterized in that the first element is connected to the piston to be adjustable in the movement direction of the piston relative to the piston.

5. A hot-gas reciprocating machine as claimed in claim 4, characterized in that the second element is arranged in the buffer space to be adjustable in the movement direction of the piston relative to the buffer space.

* * * * *